US006049309A

United States Patent [19]

Timoshin et al.

[11] Patent Number: 6,049,309

[45] Date of Patent: Apr. 11, 2000

[54] MICROSTRIP ANTENNA WITH AN EDGE GROUND STRUCTURE

[75] Inventors: Vladimir G. Timoshin; Alexander M. Soloviev, both of Moscow, Russian Federation

[73] Assignee: Magellan Corporation, Santa Clara, Calif.

[21] Appl. No.: 09/056,723

[22] Filed: Apr. 7, 1998

[51] Int. Cl.[7] ..... H01Q 1/38

[52] U.S. Cl. ..... 343/700 MS; 343/829

[58] Field of Search ..... 343/700 MS, 702, 343/729, 829, 846, 830; H01Q 1/36, 1/38, 21/06

[56] References Cited

U.S. PATENT DOCUMENTS 4,386,357 5/1983 Patton ..... 343/700 MS
4,700,194 10/1987 Ogawa et al. ..... 343/700 MS
5,410,323 4/1995 Kuroda ..... 343/700 MS
5,633,646 5/1997 Strickland ..... 343/700 MS

FOREIGN PATENT DOCUMENTS 5226922 3/1993 Japan ..... H01Q 13/08

*Primary Examiner*—Don Wong
*Assistant Examiner*—Tho Phan
*Attorney, Agent, or Firm*—Majestic, Parsons, Siebert & Hsue

[57] ABSTRACT

In a microstrip patch antenna, multipath signals from below the horizon can be reduced by forming ground elements along the edge of the dielectric substrate. Additionally, by using lugs and capacitive elements in the patch antenna, the bandwidth of the antenna can be expanded while maintaining all other antenna characteristics as good as possible.

40 Claims, 8 Drawing Sheets

MICROSTRIP ANTENNA WITH AN EDGE GROUND STRUCTURE

BACKGROUND OF THE INVENTION

The present invention relates to antennas and particularly relates to microstrip antennas used to receive global positioning data from satellites.

The United States Government has placed into orbit a number of satellites as part of a global positioning system (GPS). A GPS receiver gets signals from several GPS satellites and can very accurately determine certain parameters, such as position, velocity, and time. There are both military and commercial uses for GPS systems. A primary military use is in aircrafts or ships to constantly determine the position and velocity of a plane or a ship. An example of a commercial use includes surveying and the accurate determination of a fixed point location or the difference between two fixed points, with a high degree of accuracy. Another example is a generation of a high-accuracy timing reference.

Each satellite continually transmits two L-band signals. A receiver simultaneously detects signals from several satellites and processes them to extract information from the signals in order to calculate desired parameters such as, for example, position, velocity or time. The United States Government has adopted standards for these satellite transmissions so that others may use the satellite signals by designing receivers for specific purposes. The satellite transmission standards are set forth by an "Interface Control Document" of Rockwell International Corporation, entitled "NAVSTAR GPS Segment/Navigation User Interfaces", dated Sep. 26, 1994, as revised on Dec. 19, 1996.

Each satellite transmits an L1 signal on 1575.42 MHz carrier. A second, L2 signal is transmitted by each satellite, having a carrier frequency of 1227.6 MHz. Both signals are modulated in the satellite by a pseudo-random signal function that is unique to that satellite. This results in a spread-spectrum signal that resists radio-frequency noise or an intentional jamming. It also allows the L-band signals from a number of satellites to be individually identified and separated in the receiver. One pseudo-random function is the precision code (P-code), it modulates both of the L1 and L2 carriers in the satellite. The P-code has a 10.23 MHz clock rate and thus causes the L1 and L2 signals to have a 20.46 MHz bandwidth. The length of the code is seven days; that is, the P-code pattern begins again every seven days. The L1 signal of each satellite is also modulated by a second pseudo-random function or unique clear acquisition code (C/A code) having a 1.023 MHz clock rate and repeating its pattern once every millisecond. Further, the L1 carrier is modulated by a 50 bit-per-second navigational data stream which provides certain information of satellite identification, status and the like.

In the receiver, the process of demodulating the satellite signals corresponding to the known pseudo-random functions are generated and aligned in phase with those modulated onto the satellite signals. The phase of the carriers from each of the satellites being tracked is measured from the result of correlating each satellite signal with a locally generated pseudo-random function. The relative phase of the carrier signals from a number of satellites is a measurement that is used by a receiver to calculate the desired end values of distance, velocity, time, etc. Since the P-code encrypted functions are classified by the U.S. Government so that they can be used for military purposes only, commercial users of the GPS must work directly only with the C/A code pseudo-random function.

The Government of the former U.S.S.R. has placed into orbit a similar satellite positioning system called "GLONASS"; more information on the standard can be found in the "Global Satellite Navigation System GLONASS—Interface Control Document" of the RTCA Paper No. 518-91/SC159-317, approved by the Glavkosmos Institute of Space Device Engineering, the official former U.S.S.R. GLONASS responsible organization. The GLONASS device has L1 carrier frequencies in the range of 1602–1616 MHz.

Devices receiving the global satellite positioning signal typically use microstrip patch antennas. The antennas are designed to strongly receive the energy in the wavelength range transmitted by the satellites. In many examples, the antennas are designed to receive a narrow bandwidth of the right-hand circular polarized waves of a certain band such as the L1 band. One example of a microstrip antenna uses a rectangular patch region positioned on a dielectric substrate. The length and width of the rectangular region are chosen in order to receive a narrow bandwidth about the L1 bands.

A microstrip patch antenna is characterized by a narrow operating frequency band, and precautions must be taken to keep the required values of the gain, the axial ratio and the voltage standing wave ratio (VSWR) for the signals over the desired bandwidth. This is especially difficult when the L1 frequency bands of both GPS and GLONASS satellites are detected. It is desired to increase the bandwidth of antenna in order that the full L1 frequency band from both the GPS and the GLONASS devices can be received.

An additional problem with GPS and GLONASS antennas concerns multipath interference. One of the major factors influencing the final accuracy of measurements of the distance, velocity, etc., is the accuracy of the signal phase measurements. This phase measurement precision is altered, if in addition to the direct line-of-sight propagation signal, a multipath fading signal is also received. For this reason, it is desired to have an antenna that reduces the multipath signals received.

SUMMARY OF THE PRESENT INVENTION

The present invention is the microstrip antenna. In one embodiment, the microstrip antenna has a ground section near the edge of the microstrip antenna's dielectric substrate. Typical microstrip antennas have a ground plane positioned at the bottom of the dielectric substrate. By having an edge section which raises above the bottom of the dielectric substrate, some of the multipath signals from below the horizon can be blocked out. In effect, the antenna reduces the level of the signal received at side or back lobes. One embodiment uses a conductive material which covers the edge of the dielectric substrate. Another embodiment uses conductive vias which are formed through the dielectric substrate. If the conductive vias are spaced closely together, only a small portion of electromagnetic energy can pass through the ground edge region at the relevant wavelengths. The microstrip antenna can be manufactured with circuit board construction techniques and thus the conductive vias can be very accurately registered and formed. In one embodiment, the vias of the edge ground structure are positioned along a circular path. The circular path and ground plane below have a diameter that is preferably between ⅜ and ⅝ of the center wavelength of interest.

An advantage of the edge ground structure of the present invention is that it can be manufactured by typical circuit board construction techniques. No complicated additional metal ground connections are required. Additionally, the inventors have determined that an edge ground structure that is the thickness of the dielectric material significantly reduces the detected multipath signal radiation, even if the dielectric material thickness is less than 10 millimeters.

The present invention also includes forming additional patch elements to the basic rectangular region of the patch antenna section. The lugs are added to the rectangular region and the capacitive elements are positioned near the rectangular region. In the preferred embodiment, the lugs have 0.5 to 4.5 percent of the area of the rectangular region; and the capacitively coupled elements have 3.5 to 9.5 percent of the area of the rectangular region. In the preferred embodiment, the one lug is formed at a corner of the rectangular region; the second lug is positioned on a side near this corner, and a capacitively coupled element is positioned near each of the other three sides of the rectangular region. It has been found that use of the lugs and capacitive elements broadens the received bandwidth of the microstrip antenna while the thickness of the dielectric substrate is kept relatively small.

BRIEF DESCRIPTION OF THE DRAWINGS

The above and other advantages can be better understood with respect to the enclosed figures.

DETAILED DESCRIPTION OF THE PREFERRED EMBODIMENT

Figure 1:
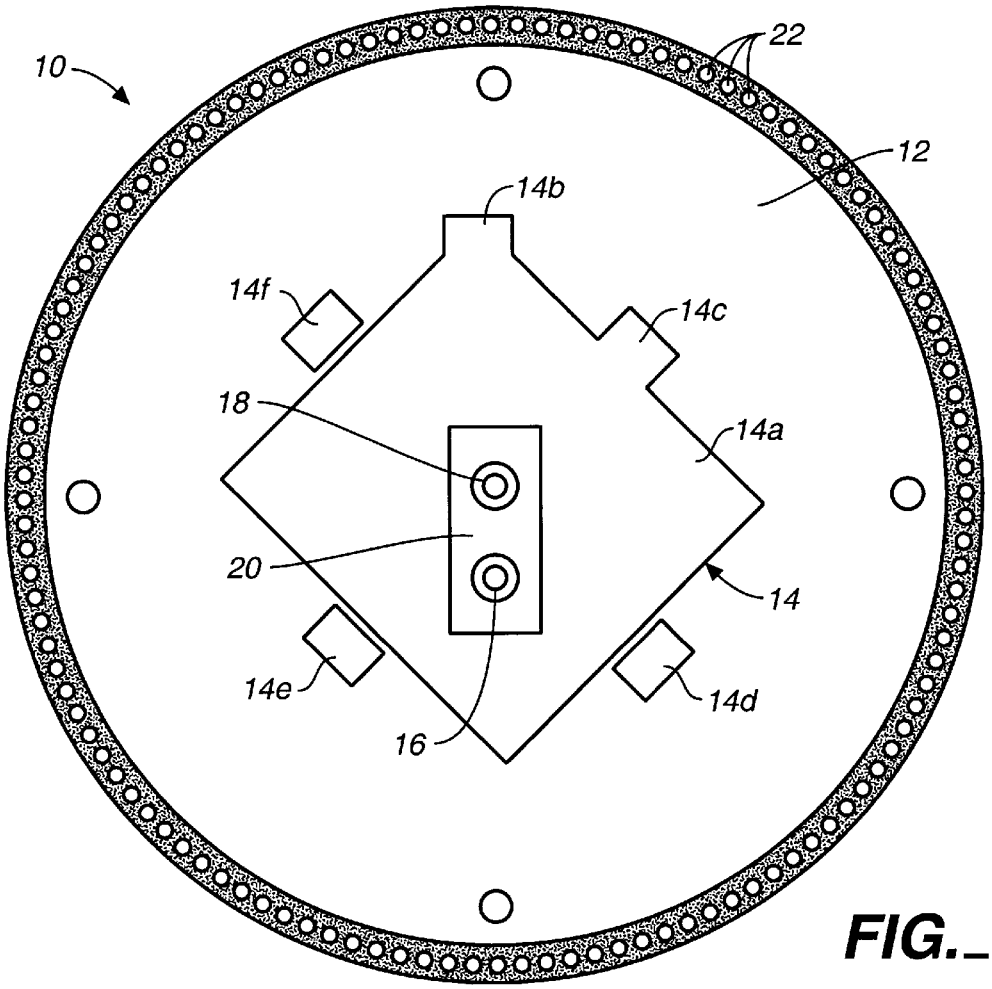
FIG. 1 is a top view of the microstrip antenna of the present invention.
Figure 2:
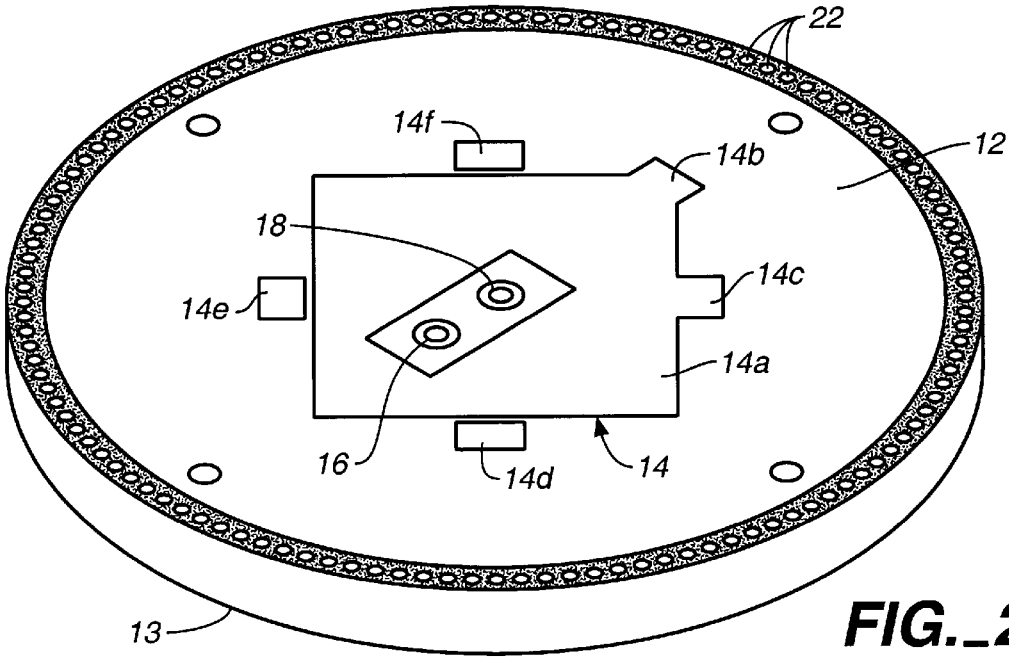
FIG. 2 is a side perspective view of the microstrip antenna of FIG. 1.

FIG. 1 is a top view of the microstrip antenna 10 of the present invention. FIG. 2 illustrates a perspective view of the microstrip antenna 10 of FIG. 1. The same reference numbers will be used for describing FIGS. 1 and 2.

The microstrip antenna 10 is formed on a dielectric substrate 12. Positioned on top of the substrate 12 is the patch antenna elements 14. Positioned underneath the substrate 12 is a ground plane 13. As is discussed below, the ground for the present invention also includes some edge elements. A coaxial feed-point 16 connects to the patch antenna elements 14 without contacting the ground plane. A short maker 18 connects together the patch antenna elements 14 with the ground plane 13.

One concept of the present invention involves the use of ground structures that extends above the bottom of the dielectric substrate 12. These ground structures are preferably formed near the edge of the dielectric substrate 12. In one embodiment, these ground structures comprise conductive vias 22 arranged near the edge of the dielectric substrate 12. These vias 22 are preferably separated by less than a millimeter. In a preferred embodiment, the vias are separated by a half-millimeter. Such a distance is significantly less than the wavelengths of interest. The multipath radiation coming from below the horizon will, in effect, be filtered out by the ground elements such as the vias 22.

In an alternate embodiment, the sides of the dielectric material can be metal coated to form the edge ground structure. One advantage of using the vias is that the vias can be very accurately formed on the dielectric material. Vias are commonly used on printed circuit boards. In a preferred embodiment, the antenna, including the ground plane 13 and the patch antenna elements 14 and the edge ground elements 22 are formed by circuit board construction techniques. For example, the ground structure can be plated to form the vias 22.

One advantage of the edge-ground elements of the present invention is that there is no need for additional bulky ground structures connected to the ground plane. The inventors have found that ground structures that are about the thickness of the dielectric substrate are sufficient to effectively reduce much of the multipath radiation from below the horizon.

Additional advantages of the present invention concern the broadening of the bandwidth of the microstrip antenna. A typical way of expanding the antenna operating frequency band is to use a relatively thick dielectric substrate with moderate values of dielectric coefficient. However, the antenna efficiency can decrease significantly due to the oscillations of higher modes which becomes more likely as the thickness of the dielectric substrate is increased. Further, the oscillations of higher modes provoke a considerable cross-polarization field which significantly impairs the antenna operating characteristics.

To minimize higher mode oscillations, the optimal relative thickness of the dielectric substrate is determined to be about:

$H=0.017*\lambda*\sqrt{\epsilon}$, where $\lambda$ is the central wavelength of interest and e is the dielectric constant.

A typical microstrip patch antenna of that thickness using a rectangular patch will not receive all L1 band signals of GPS/GLONASS satellites with the same quality. In the present invention, the working frequency band of the microstrip patch antenna is expanded by changing the configuration of the patch antenna element.

The inventors have added additional elements to the basic rectangular-shaped region in order to expand the working frequency band of the antenna. Lugs, such as the lugs 14*b* and 14*c*, and a capacitively coupled elements such as the capacitively coupled elements 14*d*, 14*e* and 14*f*, are added to the basic rectangular region 14*a* of the patch antenna element 14. In a preferred embodiment, the combined area of the lugs 14*b* and 14*c* is preferably 0.5 to 4.5 percent of the area of the rectangular region 14*a* and the combined area of the capacitively coupled elements are 3.5 to 9.5 percent of the area of the rectangular region.

In a more preferred embodiment, the combined area of the lugs is 1.5 to 3.5 percent of the area of the rectangular region and the combined area of the capacitively coupled element is 4.5 to 8.5 percent of the area of the rectangular region. In one specific embodiment, the total area of the lugs is about 2.5 percent of the area of the rectangular region, and the total area of the capacitive elements is about 6.5 percent of the area of the rectangular region.

In one embodiment, a first lug 14*b* is positioned at a corner of the rectangular region 14*a*. This lug 14*b* is preferably centered about the corner. The lug 14*c* is positioned at a side of the rectangular region 14*a* near the corner on which the lug 14*b* is positioned. The capacitively coupled elements 14*d*, 14*e* and 14*f* are positioned at the other three sides of the rectangular region 14*a*.

Adding these additional elements 14*b*–14*f* allows the frequency bandwidth of the antenna to be expanded while maintaining the dielectric substrate 12 relatively thin and with a high dielectric coefficient. The substrate's dielectric coefficient is preferably greater than 4 and the substrate's thickness is preferably less than 10 millimeters.

In a preferred embodiment, the dielectric coefficient is 5 and the substrate thickness is about 7.3 millimeters. In a preferred embodiment, the substrate is a multilayered dielectric of the FR4 type, the substrate consisting of three layers of 2.36 millimeter thickness each. The dielectric coefficient of the material equals 5 and the loss tangent equals 0.022.

The rectangular region 14*a* preferably has a ratio of the long side over the short side relatively close to one. In a preferred embodiment, the ratio of the long side over the short side of the rectangular region is preferably about 1.1.

In one embodiment, the rectangular region is 41.9 millimeters by 38.1 millimeters. The lug 14*b* is placed diagonally at the corner of the rectangular patch element and has a width of 7.0 millimeters and a length of 5.0 millimeters. The other lug is located in the middle of one of the long sides and has a width of 7.0 millimeters and a length of 2.85 millimeters. The three capacitively coupled elements 14*d*, 14*e* and 14*f* have a width of 7.0 millimeters and a length of 5.0 millimeters. They are located close to the other three sides of the rectangular region with clearances of less than a millimeter. The clearance in a preferred embodiment is 0.65 millimeters.

The inventors have also optimized the diameter of the metal ground plate and the associated edge ground elements. These elements are preferably within a range of 0.35 to 0.75 of the wavelength of the diameter of interest. In a more preferred embodiment, the diameter is between 0.375 and 0.625 of the wavelength of the diameter of center. In one preferred embodiment, the diameter of the ground plane is 95 millimeters and the substrate of the microstrip patch antenna is a cylinder 99 millimeters in diameter. By keeping the diameter in the preferred range, the polarization characteristics of antenna at the angles closer to the horizon are improved, and the axisymmetric hemispheric shape of the radiation pattern is maintained with a low level of back and side lobe emission. Table 1 presents the general parameters of different versions of the microstrip patch antenna with different diameter ground planes.

TABLE I

| Diameter of cylindrical metal ground plane | Width of Radiation Patter (at -3dB level) | Axial ration at EA = 0° | Level of back and side lobe emission to peak |
|---|---|---|---|
| D = 0.375λ | 104° | 2.5 dB | −10.5 dB |
| D = 0.505λ | 101° | 2.7 dB | −16.0 dB |
| D = 0.625λ | 92° | 4.5 dB | −13.0 dB |

By choosing the diameter of the cylindrical ground plane and by adding the lugs and capacitively coupled elements of the present invention, the operating bandwidth of the microstrip patch antenna can be expanded as much as 10.5 percent, while maintaining the relatively small thickness of the dielectric substrate and achieving close to rectangular shape of the VSWR within the operating frequency band. The radiation pattern of a given microstrip antenna has an axisymmetric directional shape with a level of back and side lobe emission equal to −16 dB. Polarization characteristics are considerably improved, not only on the direction of the directional pattern maximum, but also at low elevation angles.

Figure 3:
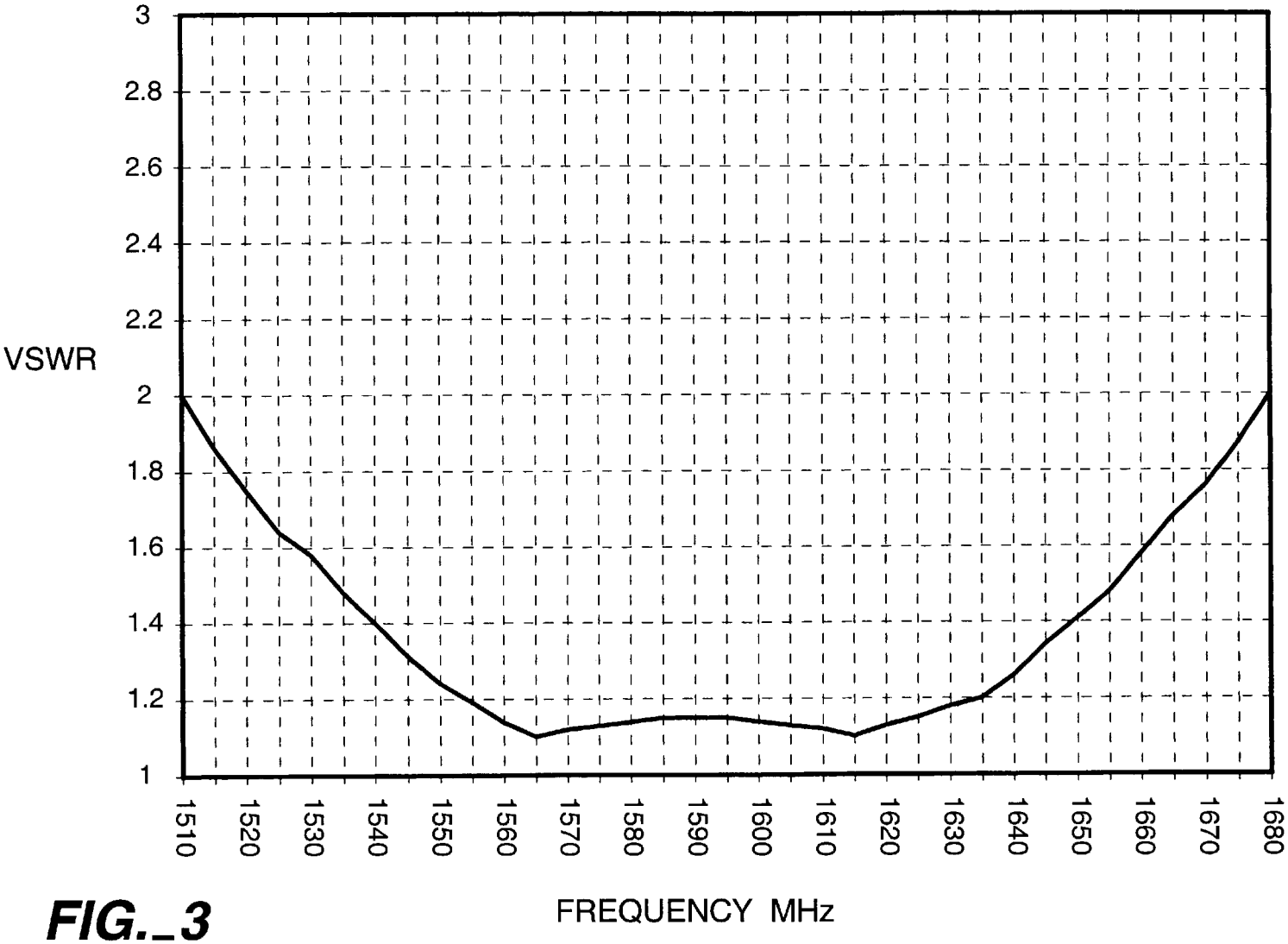
FIG. 3 is an experimentally measured frequency dependance of VSWR.
Figure 4A:
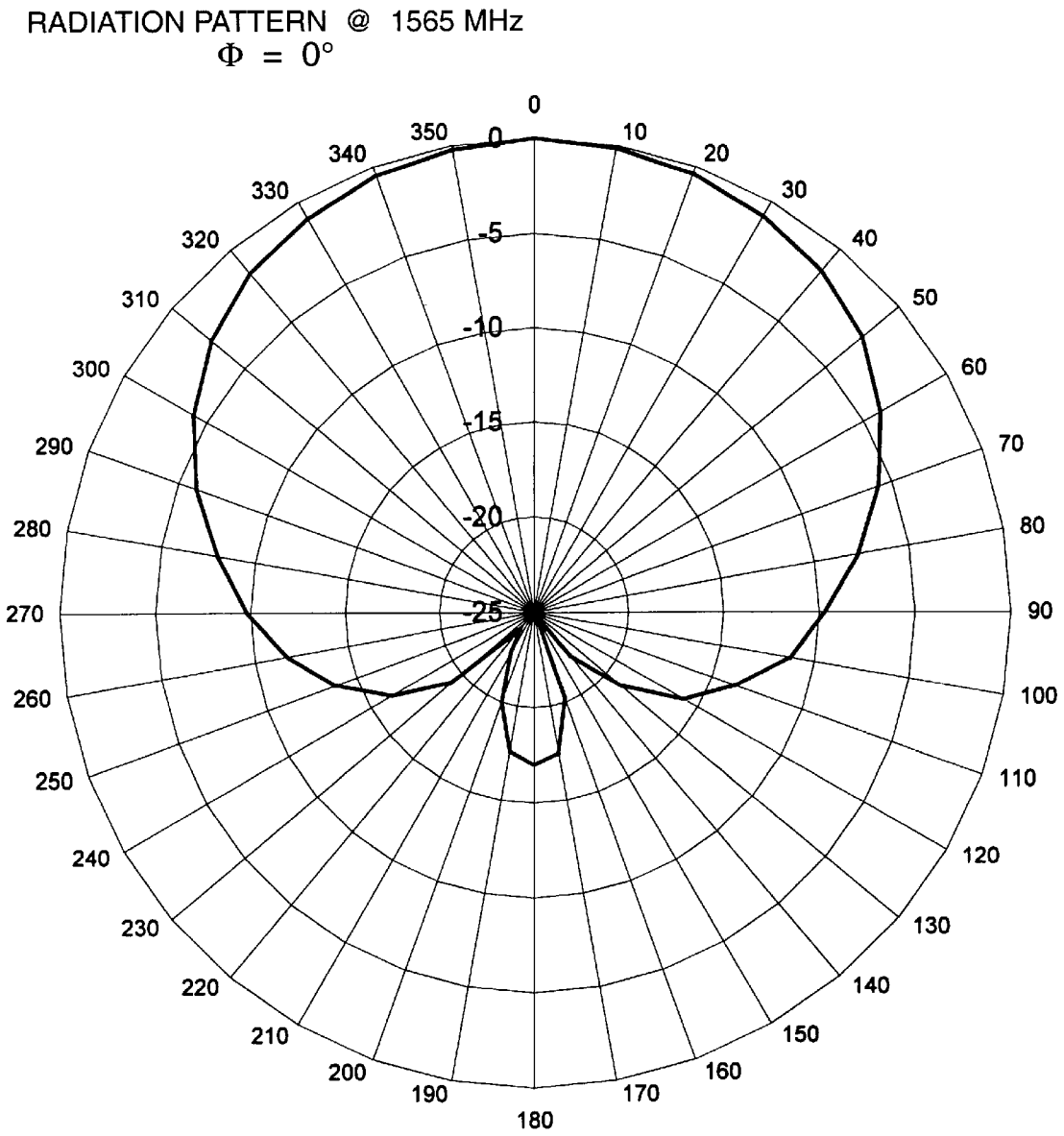
FIG. 4A is an experimentally measured Radiational Pattern of a microstrip antenna at f=1565 MHz at Φ=0°.
Figure 4B:
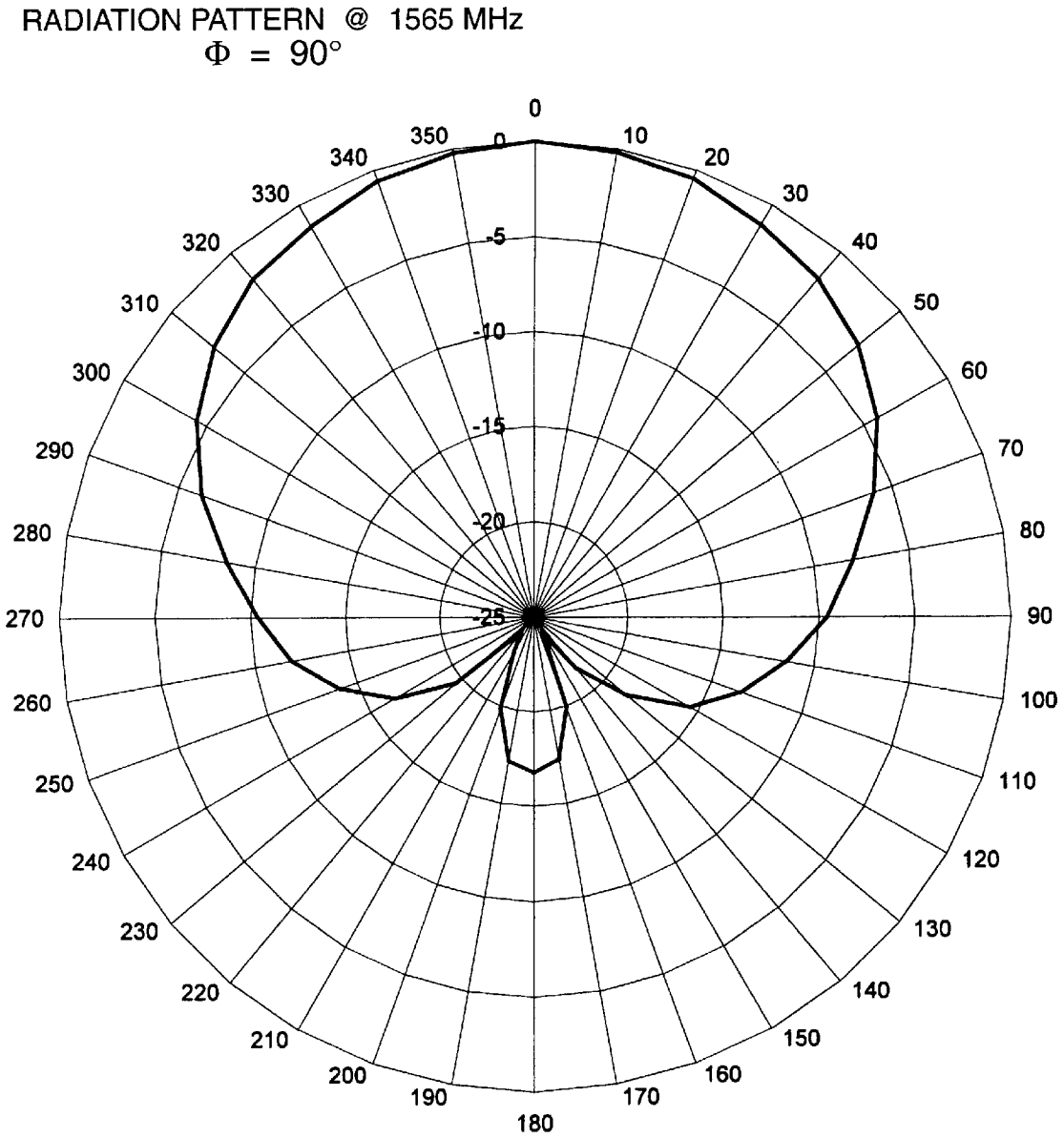
FIG. 4B is an experimentally measured Radiational Pattern of a microstrip antenna at f=1565 MHz at Φ=90°.
Figure 4C:
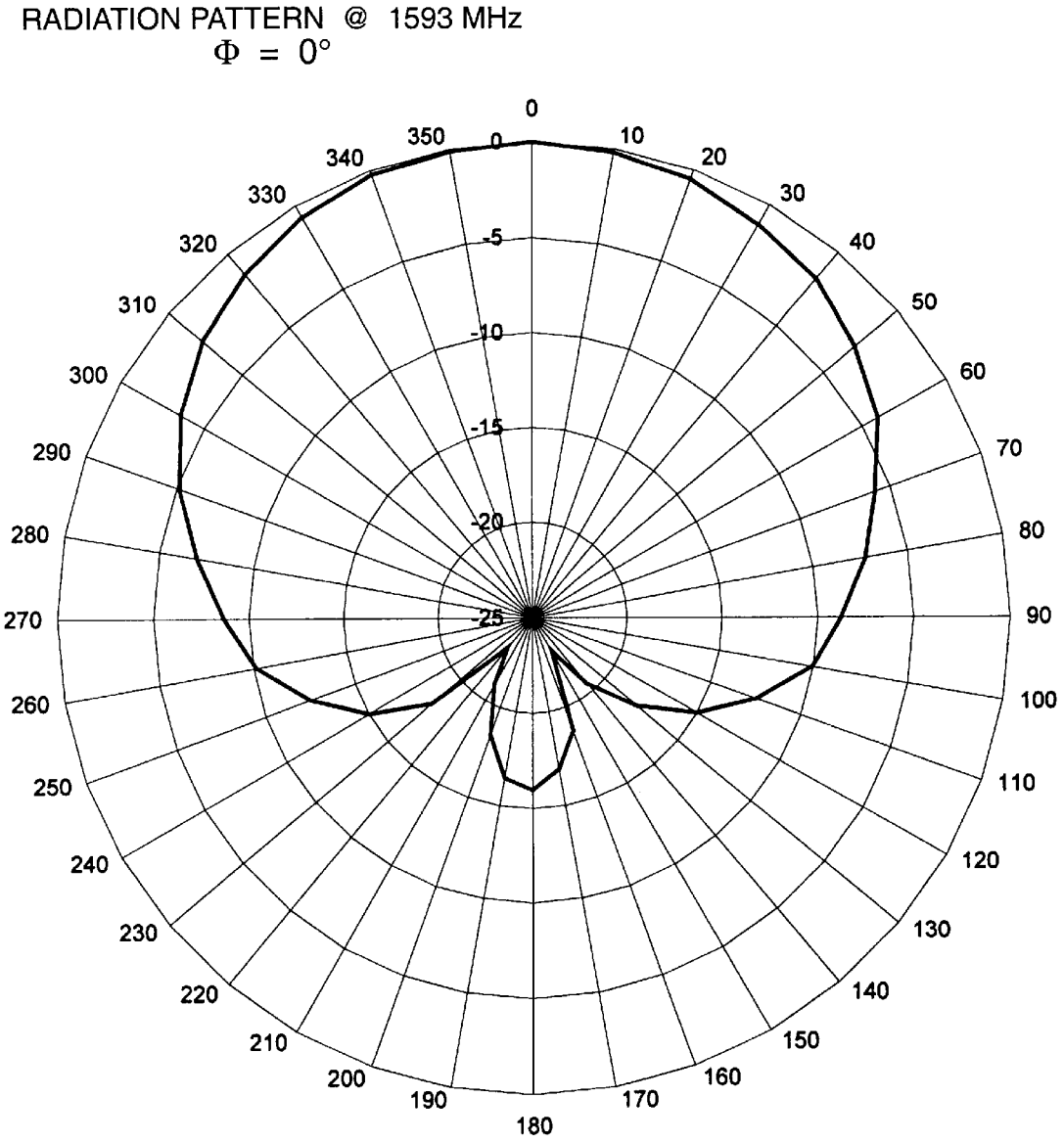
FIG. 4C is an experimentally measured Radiational Pattern of a microstrip antenna at f=1593 MHz at Φ=0°.
Figure 4D:
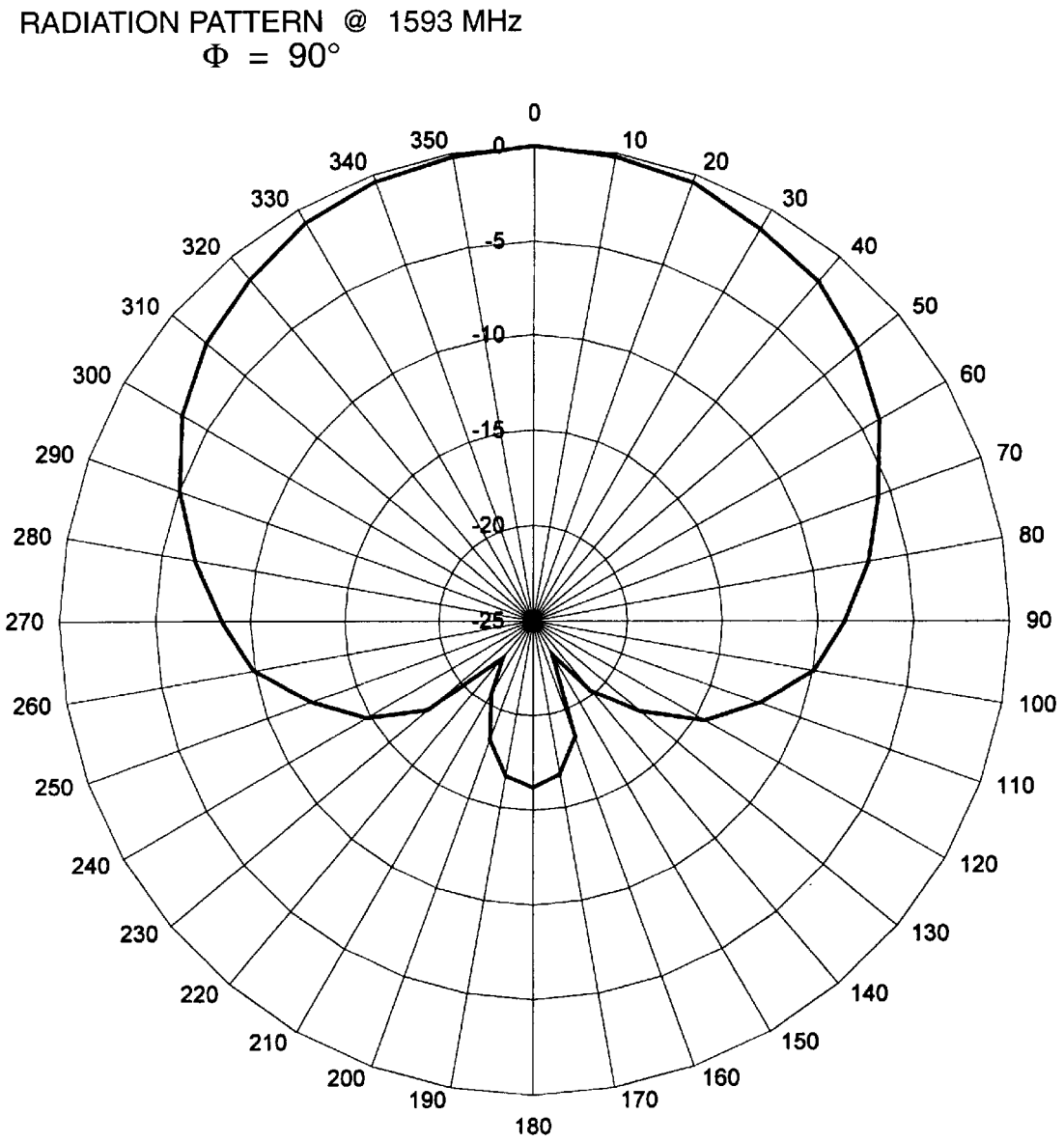
FIG. 4D is an experimentally measured Radiational Pattern of a microstrip antenna at f=1593 MHz at Φ=90°.
Figure 4E:
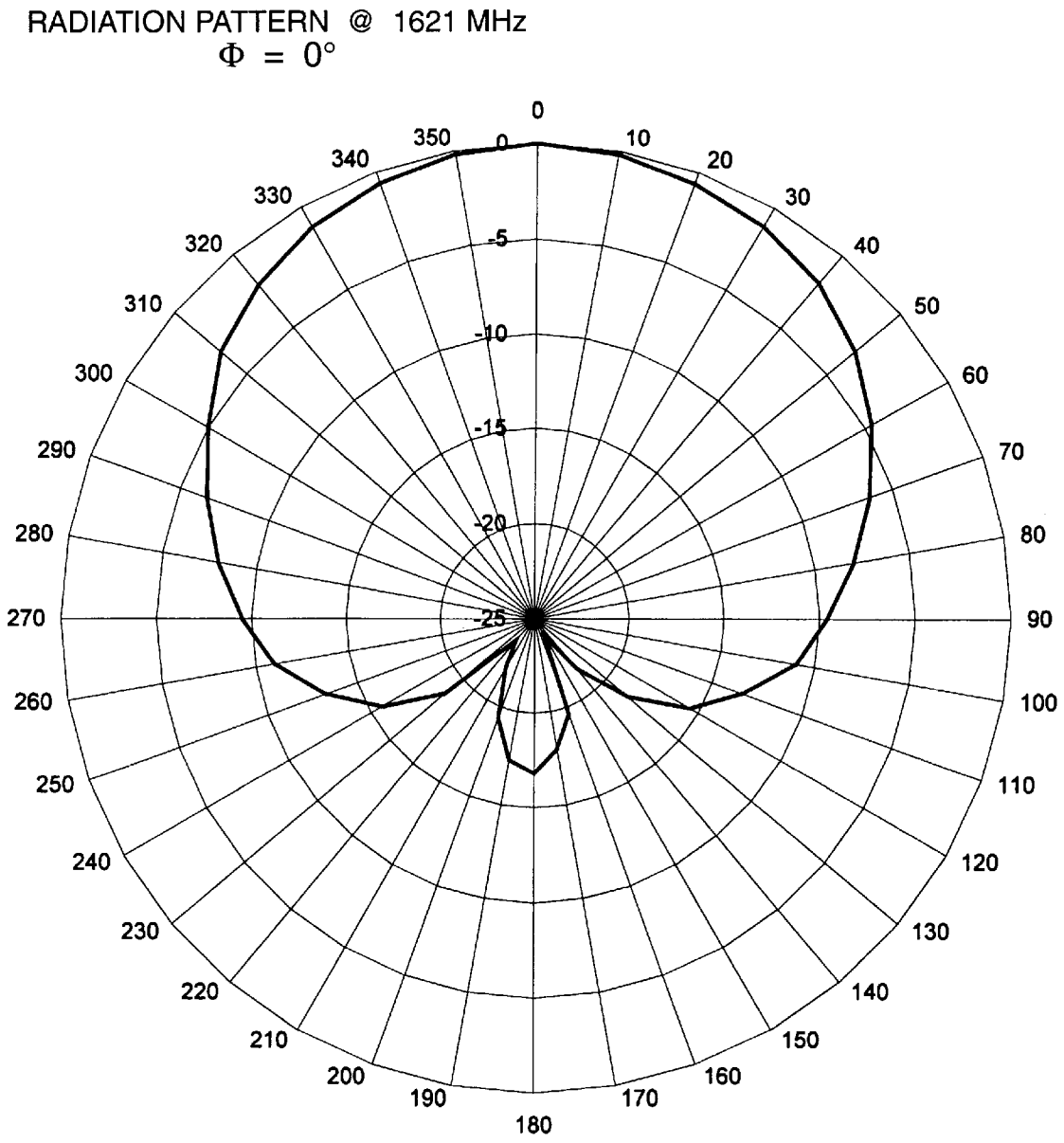
FIG. 4E is an experimentally measured Radiational Pattern of a microstrip antenna at f=1621 MHz at Φ=0°.
Figure 4F:
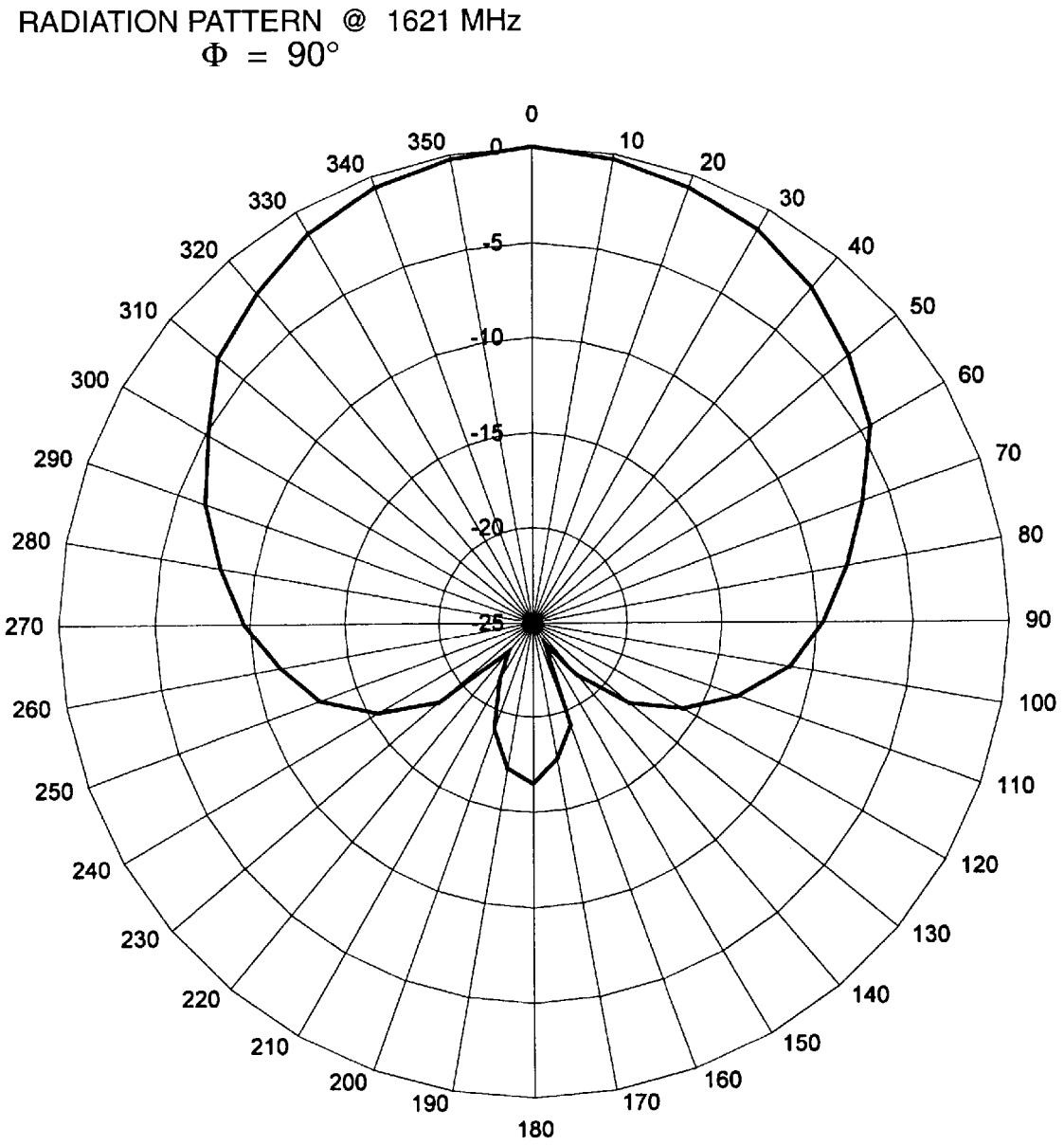
FIG. 4F is an experimentally measured Radiational Pattern of a microstrip antenna at f=1621 MHz at Φ=90°.

FIG. 3 and 4A–F are experimentally measured graphs of the operation of a preferred embodiment of the present invention. FIG. 3 is an experimentally measured frequency dependance of VSWR. FIGS. 4A–F are polar graphs the radius value indicating the intensity in decibels compared to the maximum intensity and the angle value being the angle from the normal of the plane of the antenna. Φ is the angle in the plane of the antenna. FIG. 4A is an experimentally measured Radiational Pattern of a microstrip antenna at f=1565 MHz at Φ=0°. FIG. 4B is an experimentally measured Radiational Pattern of a microstrip antenna at f=1565 MHz at Φ=90°. FIG. 4C is an experimentally measured Radiational Pattern of a microstrip antenna at f=1593 MHz at Φ=0°. FIG. 4D is an experimentally measured Radiational Pattern of a microstrip antenna at f=1593 MHz at Φ=90°. FIG. 4E is an experimentally measured Radiational Pattern of a microstrip antenna at f=1621 MHz at Φ=0°. FIG. 4F is an experimentally measured Radiational Pattern of a microstrip antenna at f=1621 MHz at Φ=90°.

Various details of the implementation and method are merely illustrative of the invention. It should be understood that various changes in such details are made within the scope of the invention, which is limited only by the appended claims.

What is claimed is:

1. A microstrip antenna comprising:

a dielectric substrate;

a patch antenna element on the top of the dielectric substrate;

a ground connected to the dielectric substrate, said ground including a ground structure that extends above the bottom of the dielectric substrate, said ground structure physically contacting the dielectric substrate without physically contacting the patch antenna element;

a feeder connected to the patch antenna element; and a short-maker connecting the patch antenna element and the ground.

2. The microstrip antenna of claim 1, wherein the height of the ground structure is defined by the thickness of the dielectric substrate.

3. The microstrip antenna of claim 1, wherein the dielectric substrate, patch antenna element and ground are integrally formed using circuit board construction techniques.

4. The microstrip antenna of claim 1, wherein the ground including the ground structure is formed by plating the dielectric substrate.

5. The microstrip antenna of claim 1, wherein the ground structure is positioned close to the edge of the dielectric substrate.

6. The microstrip antenna of claim 1, wherein the ground structure is positioned along the edge of the dielectric substrate.

7. The microstrip antenna of claim 1, wherein the ground structure comprises a number of conductive vias formed through the dielectric substrate.

8. The microstrip antenna of claim 1, wherein the ground includes a portion covering the bottom of the dielectric substrate.

9. The microstrip antenna of claim 1, wherein the antenna is tuned to receive the L1 frequency band of both GPS and GLONASS systems.

10. The microstrip antenna of claim 1, wherein the antenna is a single input.

11. The microstrip antenna of claim 1, wherein the thickness of the dielectric substrate is less than 10 mm and the dielectric constant is greater than 4.

12. A microstrip antenna comprising:

a dielectric substrate;

a patch antenna element on the top of the dielectric substrate;

a ground connected to the dielectric substrate, said ground including a ground structure that extends above the bottom of the dielectric substrate, said ground structure physically contacting the dielectric substrate, wherein the ground structure is arranged along a substantially circular path;

a feeder connected to the patch antenna element; and a short-maker connecting the patch antenna element and the ground.

13. The method of claim 12, wherein the substantially circular path has a diameter in the range of 0.35 to 0.75 of the central wavelength of interest of the antenna.

14. The method of claim 12, wherein the substantially circular path has a diameter in the range of 0.375 to 0.625 of the central wavelength of interest of the antenna.

15. A microstrip antenna comprising:

a dielectric substrate;

a patch antenna element on the top of the dielectric substrate, wherein the patch antenna element includes a rectangular region with additional lugs and capacitively coupled elements;

a ground connected to the dielectric substrate, said ground including a ground structure that extends above the bottom of the dielectric substrate, said ground structure physically contacting the dielectric substrate;

a feeder connected to the patch antenna element; and a short-maker connecting the patch antenna element and the ground.

16. The microstrip antenna of claim 15, wherein the combined area of the lugs is 0.5 to 4.5% of the area of the rectangular region, and the combined area of the capacitively coupled elements is 3.5 to 9.5% of the area of the rectangular region.

17. The microstrip antenna of claim 15, wherein a first lug is located at a corner of the rectangular region, a second lug is formed at a side of the rectangular region adjacent to the corner and at least one capacitively coupled element is positioned near each of the other sides of the rectangular region.

18. A microstrip antenna comprising:

a dielectric substrate;

a patch antenna element on the top of the dielectric substrate;

a ground connected to the dielectric substrate, said ground including a ground structure that extends above the bottom of the dielectric substrate, said ground structure physically contacting the dielectric substrate and comprising a number of conductive vias formed through the dielectric substrate, wherein the conductive vias are closely spaced and surround the patch antenna element;

a feeder connected to the patch antenna element; and a short-maker connecting the patch antenna element and the ground.

19. A microstrip antenna comprising:

a dielectric substrate;

a patch antenna element on the top of the substrate, the patch antenna element including a rectangular region with additional lugs and capacitively coupled elements to provide an expansion of the frequency bandwidth of the antenna, the combined area of the lugs being 0.5 to 4.5% of the area of the rectangular region, and the combined area of the capacitively coupled elements being 3.5 to 9.5% of the area of the rectangular region;

a ground connected to the dielectric substrate;

a feeder connected to the patch antenna element; and a short-maker connecting the patch antenna element and the ground.

20. The microstrip antenna of claim 19, wherein a first lug is formed at a corner of the rectangular region, a second lug is formed at a side of the rectangular region adjacent to the corner and at least one capacitively coupled element is near each of the other sides of the rectangular region.

21. The microstrip antenna of claim 19, wherein the combined area of the lugs is 1.5 to 3.5% of the area of the rectangular region, and the combined area of the capacitively coupled elements is 4.5 to 8.5% of the area of the rectangular region.

22. The microstrip antenna of claim 19, wherein the capacitively coupled elements are rectangle-shaped with the long side oriented parallel to the rectangle region.

23. The microstrip antenna of claim 19, wherein the ground includes a ground structure that extends above the bottom of the substrate, the ground structure physically contacting the dielectric substrate.

24. The microstrip antenna of claim 23, wherein the ground structure comprises a number of conductive vias formed through the dielectric substrate.

25. The microstrip antenna of claim 23, wherein the ground structure is arranged along a substantially circular path which has a diameter in the range of 0.375 to 0.625 of the central wavelength of interest of the antenna.

26. A microstrip antenna comprising:

a dielectric substrate;

a patch antenna element on the top of the substrate, the patch antenna element including a rectangular region with additional lugs and capacitively coupled elements, the lugs and adjacent capacitively coupled elements providing an expansion of the frequency bandwidth of the antenna, wherein a first lug is attached at a corner of the rectangular region, a second lug is attached at a side of the rectangular region adjacent to the corner and at least one capacitively coupled element is near each of the other sides of the rectangular region;

a ground connected to the dielectric substrate;

a feeder connected to the patch antenna element; and a short-maker connecting the patch antenna element and the ground.

27. The microstrip antenna of claim 26, wherein the combined area of the lugs is 0.5 to 4.5% of the area of the rectangular region and the combined area of the capacitively coupled elements is 3.5 to 9.5% of the area of the rectangular region.

28. The microstrip antenna of claim 26, wherein the capacitively coupled elements are rectangle-shaped with the long side oriented parallel to the rectangle region.

29. The microstrip antenna of claim 26, wherein the second lug is on one of the long sides of the rectangle region.

30. The microstrip antenna of claim 26, wherein the thickness of the dielectric substrate is less than 10 mm and the dielectric constant is greater than 4.

31. The microstrip antenna of claim 26, wherein clearance between the capacitively coupled elements and the rectangular region is less than a millimeter.

32. The microstrip antenna of claim 26, wherein the ground includes a ground structure that extends above the bottom of the substrate, the ground structure physically contacting the dielectric substrate.

33. The microstrip antenna of claim 32, wherein the ground structure comprises a number of conductive vias positioned through the dielectric substrate.

34. The microstrip antenna of claim 32, wherein the ground structure is arranged along a substantially circular path which has a diameter in the range of 0.375 to 0.625 of the central wavelength of interest of the antenna.

35. A microstrip antenna comprising:

a dielectric substrate;

a patch antenna element on the top of the substrate, the patch antenna element including a rectangular region with additional lugs and capacitively coupled elements to provide an expansion of the frequency bandwidth of the antenna;

a ground connected to the dielectric substrate, the ground including a ground structure that extends above the bottom of the substrate, the ground structure physically contacting the dielectric substrate;

a feeder connected to the patch antenna element; and a short-maker connecting the patch antenna element and the ground.

36. The microstrip antenna of claim 35, wherein the combined area of the lugs is 0.5 to 4.5% of the area of the rectangular region and the combined area of the capacitively coupled elements is 3.5 to 9.5% of the area of the rectangular region.

37. The microstrip antenna of claim 35, wherein a first lug is attached at a corner of the rectangular region, a second lug is attached at a side of the rectangular region adjacent to the corner and at least one capacitively coupled element is near each of the other sides of the rectangular region.

38. The microstrip antenna of claim 35, wherein the width of the dielectric substrate is less than 10 mm and the dielectric constant is greater than 4.

39. The microstrip antenna of claim 35, wherein the ground structure comprises a number of conductive vias formed through the dielectric substrate.

40. The microstrip antenna of claim 35, wherein the ground structure is arranged along a substantially circular path which has a diameter in the range of 0.375 to 0.625 of the central wavelength of interest of the antenna.

* * * * *